US005406902A

United States Patent [19]

Heinsohn et al.

[11] Patent Number: 5,406,902

[45] Date of Patent: Apr. 18, 1995

[54] METHOD AND APPARATUS FOR OPTIMUM SAIL SHAPING

[76] Inventors: Gerd Heinsohn, 11221 S. Glen Rd., Potomac, Md. 20854; Francis M. Manion, 1705 Evelyn Dr., Rockville, Md. 20852

[21] Appl. No.: 248,039

[22] Filed: May 24, 1994

[51] Int. Cl.[6] ..... B63B 15/00

[52] U.S. Cl. ..... 114/97; 114/102

[58] Field of Search ..... 114/39.1, 39.2, 89, 114/90, 96, 97, 98, 99, 102, 103, 104

[56] References Cited

U.S. PATENT DOCUMENTS

| | | | |
|---|---|---|---|
| 879,986 | 2/1908 | Tatchell . | |
| 3,310,017 | 3/1967 | Dyer . | |
| 4,503,796 | 3/1985 | Bierig . | |
| 4,649,848 | 3/1987 | Belvedere . | |
| 4,685,410 | 8/1987 | Fuller . | |
| 4,733,624 | 3/1988 | Belvedere . | |
| 5,035,194 | 7/1991 | Dougherty | 114/102 |
| 5,275,117 | 1/1994 | Magnan | 114/102 |

FOREIGN PATENT DOCUMENTS

| | | | |
|---|---|---|---|
| 2472508 | 7/1981 | France . | |
| 1904800 | 8/1970 | Germany . | |
| 2900908 | 7/1980 | Germany . | |
| 1393369 | 5/1975 | United Kingdom | 114/97 |
| 1512858 | 10/1989 | U.S.S.R. . | |

OTHER PUBLICATIONS

"Put in the Right Shape for the Conditions", May, 1994 SAIL, pp. 14–23, by Dennis Conner.

*Primary Examiner*—Stephen P. Avila

[57] ABSTRACT

A boom for a sailboat is controllably flexible to assume a predetermined specific airfoil-derived contour and to impose an aerodynamically efficient shape on the large lower portion of the sail. The boom is formed of five segments connected by four flex joints. The lengths of the segments and the hinge angles assumed by the flex joints are determined by piecewise approximation of a shape producing a pressure distribution corresponding to the pressure distribution of specific proven airfoil contours, for instance the Joukovsky airfoil profile. Flexure of the boom is achieved by tensioning cables extending along the sides of the airfoil boom. Controlled boom flexure can also be achieved by continuously varying the cross-sectional moment of inertia of the boom to match the radius of curvature of the boom with a specific airfoil profile or by inserting a controllably bendable flexible plate in a pocket along the sail foot.

38 Claims, 12 Drawing Sheets

10
12
14
16
18
20
22
24
50
51
52
53
54
57
58
60
89
91

METHOD AND APPARATUS FOR OPTIMUM SAIL SHAPING

BACKGROUND OF THE INVENTION

1. Technical Field

The present invention pertains to the rigging of sailboats and, more particularly, to an improved method and apparatus for achieving improved sail shape.

2. Discussion of the Prior Art

Sailboats rely on the aerodynamic force produced by the longer path and consequently higher speed of air flow over the convex leeward surface of the sail relative to the path across the concave windward surface. The pressure caused by the faster leeward flow is less than that caused by the slower windward flow, and the pressure differential generates a resultant suction force acting perpendicular to the sail to produce up to sixty to eighty percent of the total propulsive thrust generated by the sail.

Since this concept was first realized in the nineteenth century, sail design has evolved from essentially flat plates capable simply of being blown downwind to the complex shaping of modern mainsails. These incorporate luff and foot curves cut in strips of fabric in excess of straight lines, and seamed together with the excess fabric drawn up and aft into the sail to create a curvature or draft with a generally aerodynamic shape. Optimizing such designs has been limited with respect to achieving an efficient cross-sectional airfoil shape over the vertical extent of the sail by the straight flat attachment of the foot or horizontal lower edge of the sail to the rigid straight boom.

Triangular mainsails are attached all along the mast and boom and a backstay line runs from the top of the mast to the rearward end of the boom. The sail blooms under wind loading and takes a shape that resembles an airfoil over its upper portion (if properly trimmed) but is forced to return to a straight shape along its foot since it is securely fastened all along the rigid straight boom. For a triangular sail the center of effort (centroid) lies above the lower one-third of the sail up from the foot, and a greater portion of the sail thrust-producing area is in the lower portion near the aerodynamically inefficient straight boom-foot attachment. In addition, the maximum lateral deflection or draft of a traditionally rigged sail under wind loading is at about midheight, with much of the wider foot portion deflected significantly less.

Some flex in the mast or rigging mitigates the severity of the transition from the bellowed interior to the foot. The return to a near linear contour, however, especially at the largest and most critical portion of the sail, still results in significant lost propulsive thrust. Perhaps equally as detrimental, the center of pressure is displaced higher up the sail, increasing the overturning moment arm acting between the wind pressure and the water resistance and compromising boat handling. If the foot of the sail were given a curved airfoil shape, then the maximum deflection, or sail draft, would be at the foot, resulting in a considerably larger surface area to collect the wind. In addition, the center of pressure would be lowered as well allowing a fuller, deeper, more powerful sail shape to be used in heavier wind without producing difficult to handle and hydrodynamically inefficient heeling in the hull.

The concept of the sail as an airfoil and even the concept of boom shaping to capitalize on airfoil thrust has been discussed in the literature. Exemplary of such approaches are U.S. Pat. No. 879,986 (Tatchell) and U.S. Pat. No. 3,310,017 (Dyer). These proposals, however, have offered no guidance in selecting and shaping a boom to achieve a specifically efficient airfoil contour. A merely flexible boom will assume a pseudo-aerodynamic curvature to achieve a sail shape minimizing net force; however, the thrust efficiency will be poor. An airfoil improperly matched to the sailboat environment is susceptible to premature air flow separation over the leeward surface with an attendant sharp decline in propulsive thrust. Soviet Union Patent No. 1,512,858 (Pivkin et al) illustrates a four section hinged boom but no characterization of section length or hinge angle is provided to indicate shaping in correspondence with any particular aerodynamic profile.

A primary problem with the prior art sail booms is that no method or criteria to select and continuously approximate a specific airfoil shape matched to the sailing environment has been defined. Another problem is the complex and obtrusive rigging proposed to control even the very suboptimized boom shaping devices of the prior art. These are inconvenient and sometimes dangerous for sailors forced to maneuver around them to control the boat. Another difficulty is that the prior art approaches to sail-foot profiling require costly replacement of existing booms without a backfit modification option available.

SUMMARY OF THE INVENTION

Accordingly it is a primary object of the present invention to overcome the aforementioned disadvantages of the prior art by providing a sailboat boom producing a specific aerodynamically efficient sail profile along the foot of the sail.

Another object of the present invention is to increase the net wind thrust of the sail and thus increase the speed of the sailboat.

It is a further object of the present invention to lower the center of the pressure of wind on a sailboat sail to improve sailboat handling and reduce drag.

A still further object of the present invention is to provide a sailboat boom having the ability to controllably assume the profile of a prespecified airfoil.

Yet another object of the present invention is to provide a sailboat boom selectively controllable to assume adjustable airfoil configurations requiring minimum deck space and rigging complexity.

It is also an object of the present invention to provide a method and apparatus to force a sail to assume an efficient airfoil profile when attached to a traditional straight boom.

The present invention is generally characterized as a selectively controllable curvable sailboat boom for producing a specific airfoil profile in the foot of a sail. In a preferred embodiment the boom comprises a plurality of rigid segments attached end to end by angularly controlled flex joints. The lengths of the rigid segments and angles assumed by the flex joints are selected and controlled to produce a pressure distribution corresponding to a linear approximation of a specific airfoil generated profile. The boom is controlled by cables extending along each side and can be differentially tensioned to bend to either side or held straight by equal tension on each side. In an alternative embodiment the airfoil profile is achieved by varying the cross-sectional moment along the boom length to match the local bending ratios to those of a selected airfoil generated profile.

Both the Joukovsky and the NACA 0018 profiles are examples of airfoils which after years of aeronautic research have been proven to have attractive high thrust-low drag characteristics in the air speed regime characteristic of sailboat environments.

Some of the advantages of the present invention over the prior art are that a controllable airfoil boom having a Joukovsky generated or near Joukovsky profile is less likely to induce flow separation across the sail than a smooth aerodynamic arc, the boom is of uncomplicated design and easy and inexpensive to manufacture, the control system is compact and not intrusive on deck space and can be simply automated to respond to varying sailing conditions, and the boom can be controlled to assume a straight configuration for conventional sailing as desired. The apparatus of the present invention can be modified for installation on existing sailboat masts or new construction and can further be efficiently applied to virtually any wind-driven conveyance.

Other objects and advantages of the present invention will become apparent from the following description of the preferred embodiments taken in conjunction with the accompanying drawings wherein like parts in the different figures are identified by the same reference numbers.

DESCRIPTION OF THE PREFERRED EMBODIMENTS

Figures 1, 3:
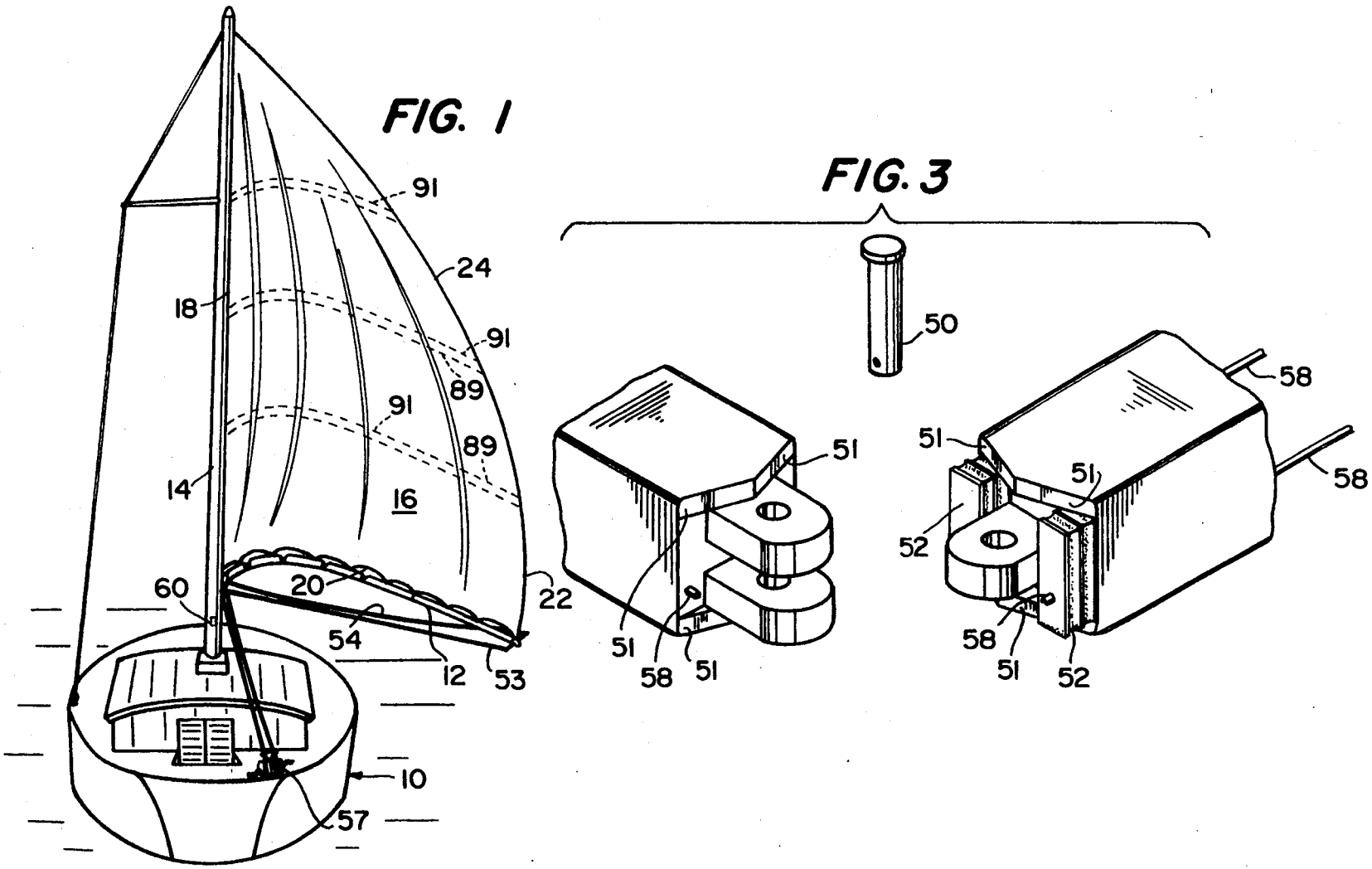
FIG. 1 is a perspective view of a sailboat with an airfoil boom of the present invention.
FIG. 3 is a perspective view of a flex joint of the present invention.

A sailboat 10 is shown in FIG. 1 having an airfoil boom 12 according to the present invention extending laterally from a vertical mast 14. A generally right triangular fabric sail 16 is supported along the leading edge or luff 18 by the mast, and along the lower edge or foot 20 by the boom, with a backstay line 22 running from the top of the mast to the rearward end of the boom to support the trailing edge or leech 24 of the sail. As the sail inflates under the pressure of the wind, a curved horizontal airfoil shape is assumed by the sail between the luff 18 and the leech 24. The attachment of the sail foot along the boom urges the sail to increasingly assume the contour of the boom as the sail approaches the boom.

Figure 2:
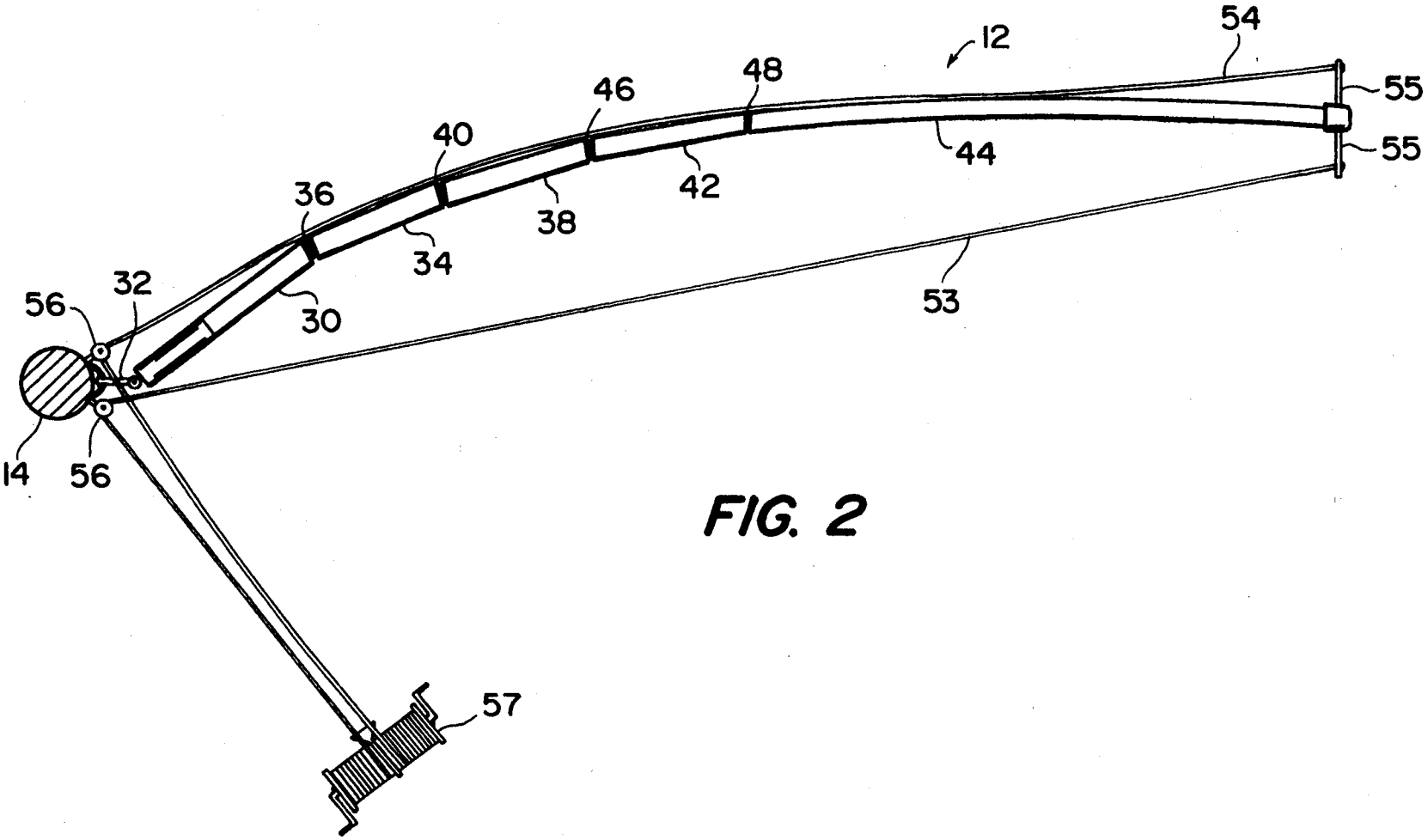
FIG. 2 is a top plan view of a four flex joint airfoil boom according to the present invention.

The airfoil boom 12 shown in FIG. 2 comprises five longitudinally sequential rigid length sections 30, 34, 38, 42 and 44 connected by four sequential pivotable flex joints 36, 40, 46 and 48. A first or forwardmost rigid section 30 is rotatably attached at its forward end to mast 14 by a conventional hinge fitting 32. First section 30 is attached at its rearward end to the forward end of a second rigid section 34 by a pivot pin flex joint 36. Second rigid section 34 is similarly attached at its rearward end to the forward end of third section 38 by a similar pivot pin flex joint 40; fourth section 42 is attached at its forward end to the rearward end of third section 38 and the forward end of the fifth or aft most section 44 is attached to the rearward end of fourth section 42 by pivot pin flex joints 46 and 48, respectively. The pivot axes for all four flex joints are vertical; therefore the boom is flexible only in the lateral direction (i.e., in a horizontal plane) and remains stiff vertically.

The single axis flex joints shown in FIG. 3 comprise strong pins 50 journaled vertically through the ends of adjacent rigid sections, but any strong hinging mechanism constrained to provide vertical rigidity and lateral rotation could be used. The opposed ends of adjacent rigid sections have tapered bearing surfaces 51 dimensioned to seat in rigid abutment at preselected angles determined according to an approximation of an airfoil contour as described below. Hard rubber bellows 52 are disposed on opposite lateral sides of pin 50 between mutually facing ends of the boom sections for shock absorbing snubbing during the rapid boom swing and reversal of airfoil contour orientation during jibing maneuvers. These bellows are sized to act as cushioned stops limiting angular flexure to predetermined values. The bellows can also serve as joint actuators as explained hereinbelow.

The boom is flexed by the action of cable lines 53 and 54, shown in FIG. 2, running the length of the boom along each lateral side from outriggers 55 at the aft end of the boom through pulleys 56 attached at or near the mast 14 and then to a hand winch 57 having a ratchet catch. Tension in the cables is controlled by the winch to bend the boom in one direction or the other in a manner similar to the bending of an archery bow, or to hold the boom straight through the application of equal tension to the two cables.

As an alternative to cable actuation, FIG. 3 also shows pressure and exhaust lines 58 running lengthwise through or along the boom sections and connecting all the bellows on respective sides of each link joint. The mechanical relief on the link limits the relative bending to the desired angle for each joint. The pressure lines provide automatic control as well as manual control of the beam flexure. In the manual mode the system is selectively flexed right or left by differentially pressurizing the bellows on opposite sides of the boom. For example, a manually actuated differential valve may be actuated to pressurize the bellows on one side of the boom and exhaust the bellows on the other. In addition, the boom can be made straight by pressurizing both the right and left lines simultaneously. Stored air under pressure in a tank is used to actuate and control flex pin rotation. A small compressor can maintain the tank pressure for ready and quick actuation. A pneumatic system is preferred for the maritime environment, however hydraulic or electro-mechanical components could be adapted for the purpose. It is noteworthy to point out even if the pneumatic line were not pressurized but instead sealed, the bellows-line arrangement provides damping of severe boom motion for a cable-actuated system.

Figure 4:
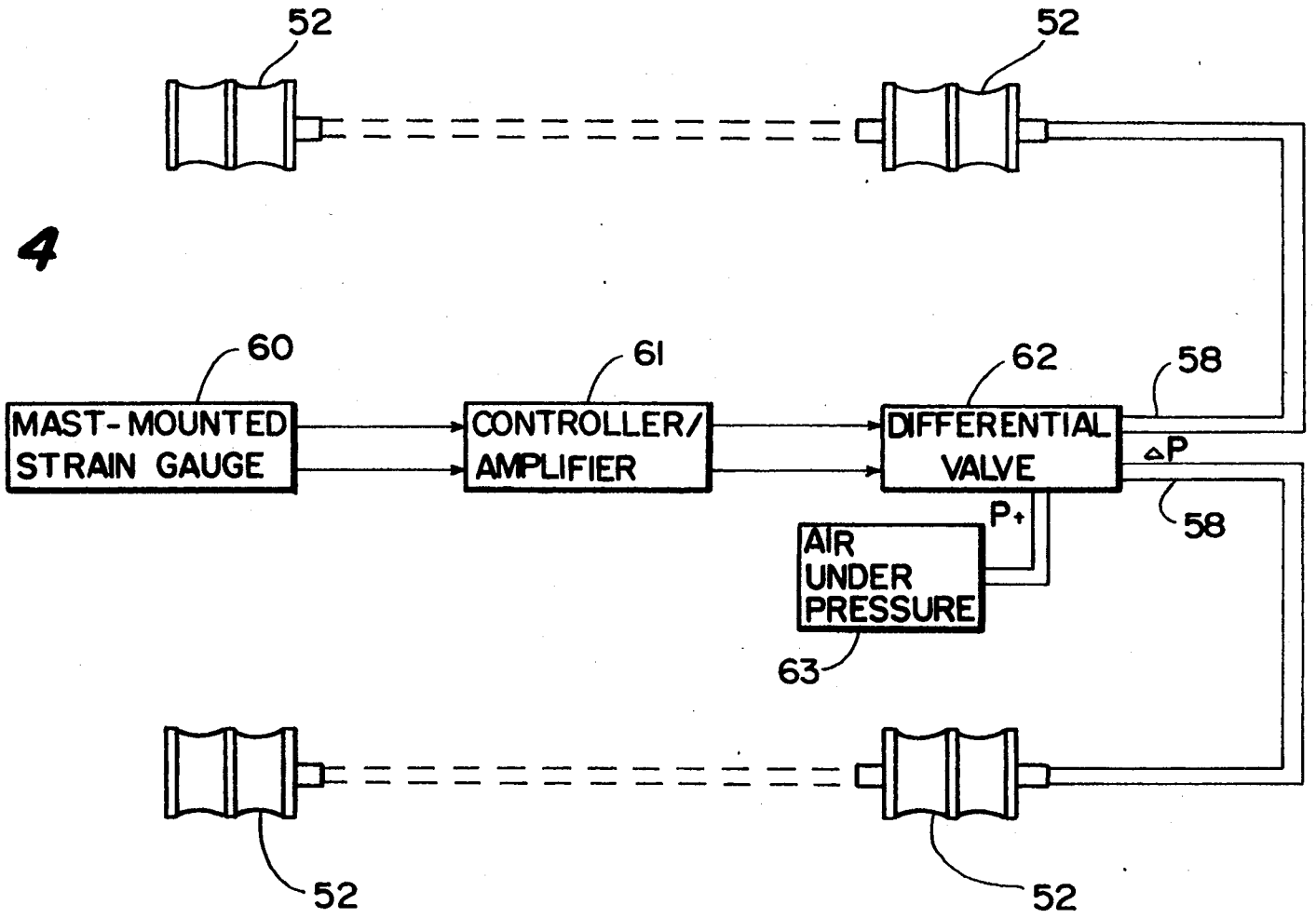
FIG. 4 is a schematic diagram of a mast strain-based automatic boom flex control system.

The strain on mast 14 is a good indicator of the total sail wind thrust. As illustrated in FIGS. 1 and 4, a strain gauge 60 mounted on the mast is used to produce a signal proportional to wind force on the sail. This wind force signal is fed through a controller-amplifier 61 to operate a differential valve 62 communicating between an air pressure source 63 and the boom bellows 52 through pressure and exhaust lines 58. The purpose of the control is to seek the maximum sail force; thus the system automatically increases boom flexure as the wind force on the sail (measured via mast strain) increases, but reduces the boom flexure when sail force decreases, a form of positive feedback.

The lengths of the five boom sections, and the flex joint angles, are determined by mathematical piecewise approximation of specific proven airfoil contours suited to the flow characteristics of sailing environments. As an example, we have found that the Joukovsky air foil, as characterized in "Boundary Layer Theory" by Hermann Schlicting, 4$^{th}$ Edition, 1962, McGraw-Hill Book Company, Inc., has been proven to be highly efficient aerodynamic shape for low speed sailboat-like applications. We have also found that a second and somewhat similar airfoil, designated NACA 0018, by the National Advisory Committee for Aeronautics, also has attractive characteristics for sailing environments. In each case the term airfoil as used herein refers to the forward or convex surface only since the sail has essentially negligible thickness from an aerodynamic perspective.

Figure 5:
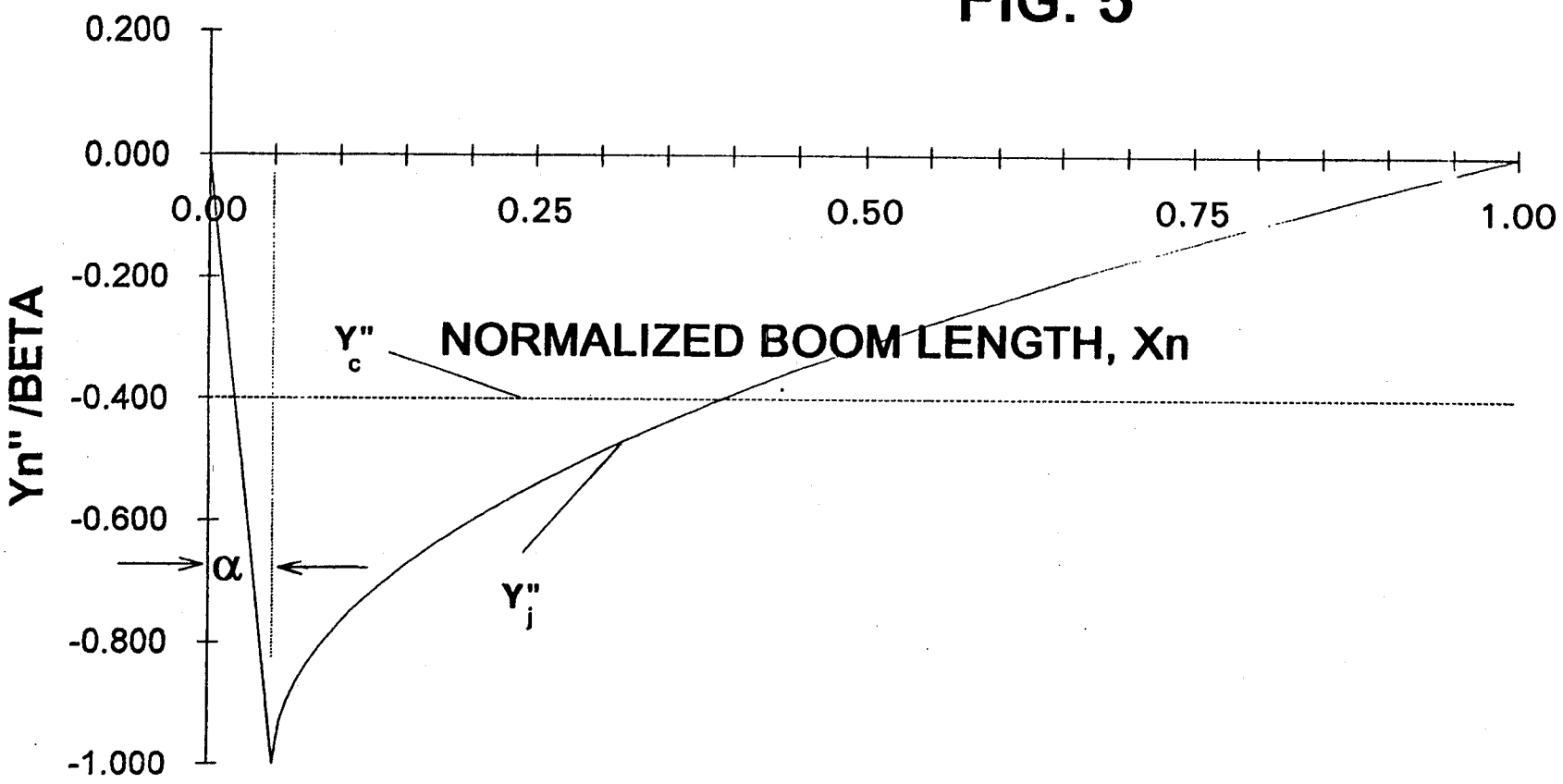
FIG. 5 is a plot of the pressure distribution, or 2nd derivative of sail deflection, for a Joukovsky airfoil and constant arc airfoils as a function of normalized length.

In an ideal flow a smooth aerodynamic arc, an arc of constant radius that a sail will naturally assume under normal wind loading, produces a larger pressure difference, or propulsive force than does the Joukovsky airfoil. FIG. 5 shows the second derivative with respect to the boom axis of the profile displacement normalized by a factor $\beta$ (defined below), denoted by $Y_j''$ and $Y_c''$ for a Joukovsky-derived sail airfoil and a constant arc airfoil, respectively. As will be developed below, this second derivative expression corresponds to the pressure difference across the sail generated by the airfoil shape.

Figure 6:
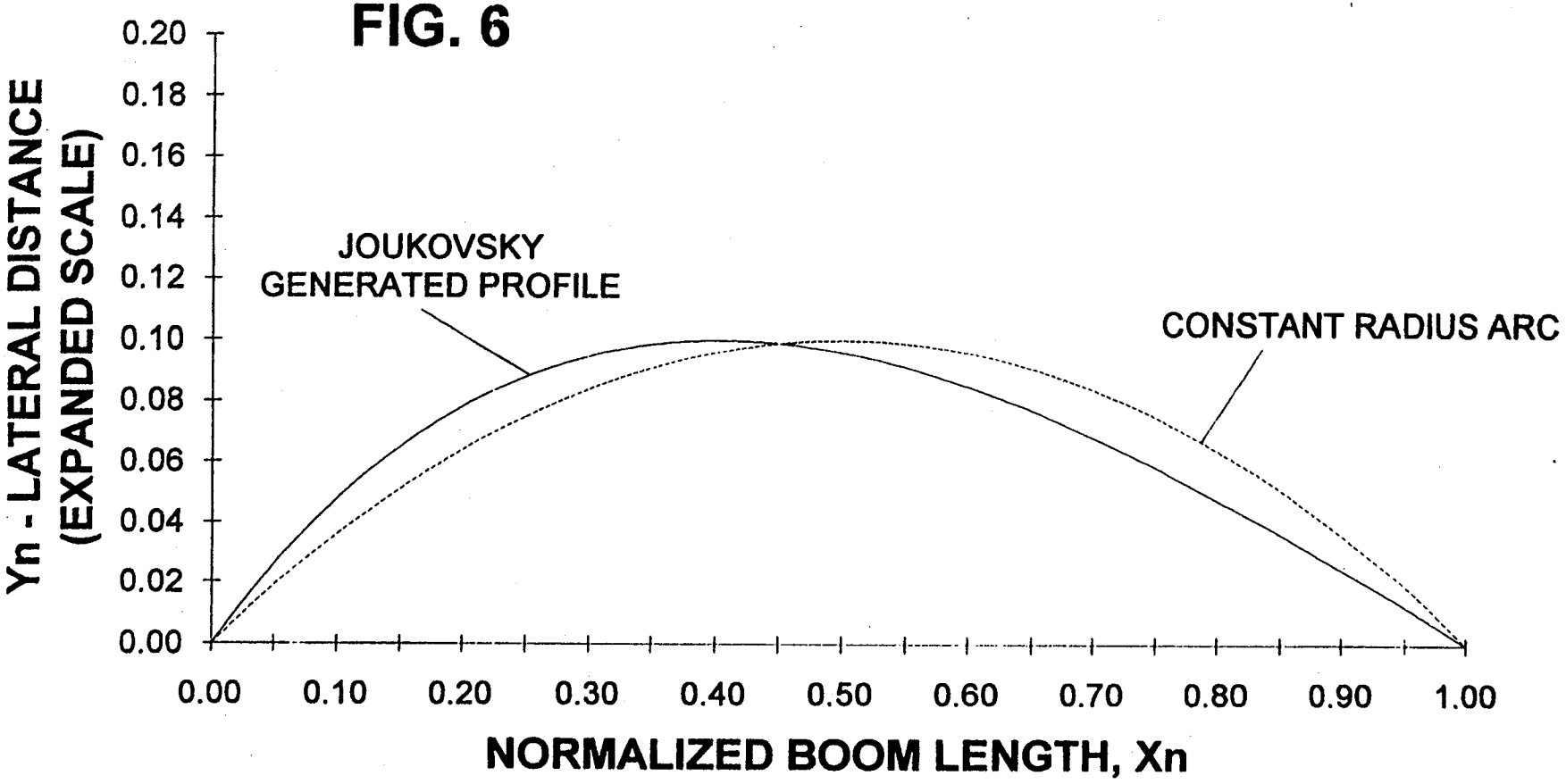
FIG. 6 is a plot of the lateral deflection of a Joukovsky generated airfoil profile and a constant arc airfoil profile as a function of normalized lengths.

In this example, the maximum displacement for both the Joukovsky and the constant arc boom profiles were set at ten percent of the boom length for purposes of comparison, and plotted against normalized boom length. A comparison of the Joukovsky profile and the smooth aerodynamic arc is shown in FIG. 6 plotted against normalized boom length.

The $Y_j''$ of the Joukovsky pressure difference profile initially is much more negative in pressure but at approximately forty percent of the boom chord the Joukovsky $Y_j''$ becomes less negative than the constant arc $Y_c''$. Integrating the normalized net pressure difference per unit width along the chord (normalized zero to one) produces a total force of $-0.68$ for the Joukovsky pressure difference profile and $-0.80$ for the constant arc. Thus, in the ideal flow situation the constant arc appears to be aerodynamically smooth and its suction surface provides more negative pressure thrust than the Joukovsky forward surface.

Aerodynamic design, however, again and again emphasizes that flow is not ideal. There is surface friction which results in boundary layer development along the surface. This boundary layer causes flow separation for the smooth aerodynamic arc much earlier, or closer to the leading edge or luff, than for the surface derived from the Joukovsky configuration. In fact, some estimates show that flow separation occurs for the smooth aerodynamic arc at sixty percent or earlier of the chord length. If one assumes flow separation at sixty percent of chord length, then suction force falls for the constant arc surface from an ideal of 0.80 to 0.48, corresponding to only seventy-one percent of that of the Joukovsky pressure difference profile. Since the Joukovsky airfoil gains most of its suction force in the initial part of the profile (i.e., closer to the leading edge), it is far less degraded by flow separation. In fact the Joukovsky derived airfoil radius of curvature is far more gentle than the smooth arc over the last sixty percent of the profile, and thus is much less susceptible to flow separation in this part of the profile. The windward surface is not susceptible to separation in the Joukovsky configuration because the pressure gradient along the flow direction is favorable.

Clearly the Joukovsky derived or near-Joukovsky derived profile is superior to that of a smooth aerodynamic arc in terms of suction or lift force produced by a sail in an actual sailing environment rather than in an idealized flow. Perhaps equally as important, imposing a Joukovsky-like airfoil shape on the boom and consequently over the vertical extent of the sail, including the bottom of the sail, lowers the center of pressure exerted by the wind on the sail and thereby reduces both induced roll moment and the hydrodynamic drag exerted on the hull.

To determine the surface profile for a boom that will impose a Joukovsky pressure distribution on the sail, the mathematical equation for a sail subjected to wind forces and tension loading is analyzed. This analysis shows that the displacement of the sail due to wind pressures (both positive and suction) is supported by the tension in the sail. The governing equation for the force balance shows that the net pressure per unit height for an element of the chord length (along the boom axis) is balanced by the sail tension multiplied by the local change in sail slope. The change in the local slope is the second derivative of the sail lateral deflection with respect to the distance along the boom axis.

Figure 7:
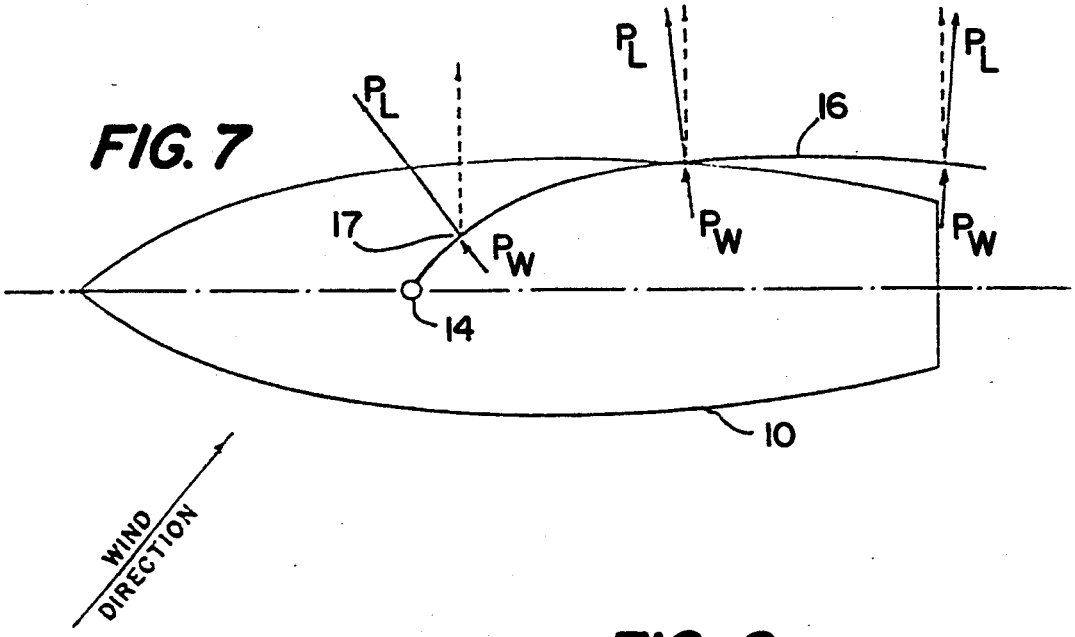
FIG. 7 is a top plan view of a sail deflected under wind pressure loading.
Figure 8:
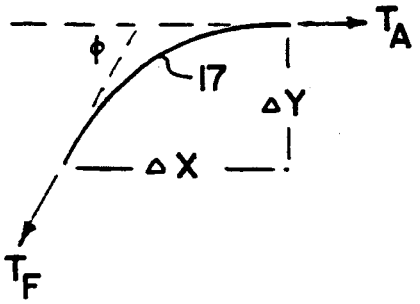
FIG. 8 is a diagrammatic top plan view of an incremental patch of wind loaded sail.
Figure 9:
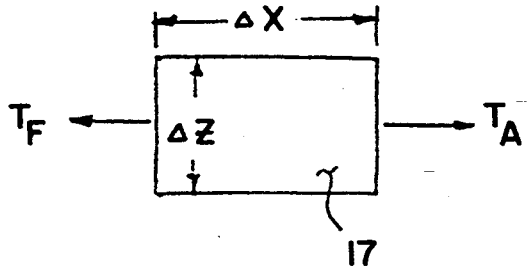
FIG. 9 is a diagrammatic front elevation view of the incremental sail patch of FIG. 8.

FIG. 7 shows a sail 16 in the wind subjected to positive pressure, $P_W$, on the windward side and negative (suction) pressure, $P_L$, on the leeward side. These forces act normally against, or perpendicular to, each sub-element 17 of the sail. A sub-element is merely a small area patch of the sail conveniently used to analyze forces. FIGS. 8 and 9 show a sub-element 17 having a width $\Delta X$, a height $\Delta Z$, and a wind induced deflection $\Delta Y$, viewed from the top and from the side, respectively. The windward and leeward pressure forces $P_W$ and $P_L$, respectively, acting on the incremental patch area are balanced by tensions developed along the edges of the patch in a generally forward direction $T_F$ and in a generally aft direction $T_A$. An angle $\Phi$ is defined between the two tension vectors corresponding to the pressure induced deflection $\Delta Y$ of the incremental patch. The resultant force balance equation can be written as:

$$(P_W-P_L)\Delta x\Delta z=T_F\sin\Phi\Delta z,$$

or simply $$\Delta p(x)\Delta x=T_F\sin\Phi \text{ where } \Delta p(x)=(P_W-P_L).$$

horizontal force balance equation is:

$$T_A=T_F\cos\Phi=\Delta p(x),$$

or $$T_F=T_A/\cos\Phi-\Delta p(x)\Delta y/\cos\Phi$$

Multiplying by sin $\Phi$, an equation for $\Delta p(x)\Delta x$ is obtained as:

$$\Delta p(x)\Delta x=T_F\sin\Phi=T_A\sin\Phi/\cos\Phi-\Delta p(x)\Delta y\sin\Phi/\cos\Phi.$$

Noting that $$\sin\phi/\cos\phi=\frac{\Delta y}{\Delta x} \text{ and that } \frac{\Delta y}{\Delta x}=y'(x),$$

which is the slope or first derivative of y with respect to x:

$$\Delta p(x)\Delta x=T_A y'(x)-\Delta p(x)\Delta y\, y'(x),$$

and $$\Delta p(x)\Delta x(1=y'(x)y'(x))=T_A y'(x).$$

Since the slopes are small, it is assumed that second order terms are very small compared to 1 and thus, $(1+y'(x)y'(x))\approx 1$. This simplifies the equation for the pressure difference in terms of the sail's local slope and the applied tension:

$$\Delta p(x)\Delta x=T_A y'(x).$$

Differentiating this equation with respect to x, the characteristic equation is obtained:

$$\Delta p(x)=T_A y''(x).$$

where: $\Delta p(x)$ is the difference pressure (varies along the chord); x is the distance measured from the front of the boom along the chord; $T_A$ is the sail tension along the chord axis, where sail tension is the force per unit length of sail material in the dimension $\Delta z$ of FIG. 9, i.e., transverse to $T_A$; and $y''(x)$ is the second derivative of the sail's lateral deflection. Defining $\Delta P_n(x)$ as the pressure difference normalized by the wind dynamic pressure, $\Delta p(x)/(\frac{1}{2}\rho V^2)$, where $\rho$ is air density and V is wind velocity, the equation can be rewritten as:

$$\Delta P_n(x)(\tfrac{1}{2}\rho V^2)=T_A y''(x)$$

In order to generalize the Joukovsky difference pressure along the boom axis, $\Delta P(x)/T_A$ will be defined as varying from 0 to $-\beta$. Normalizing the distance x along the chord by L, where L is the boom length, one obtains $X_n=x/L$, the normalized boom length. To simplify, define a normalized second derivative as:

$$Y_n''(X_n)=y''(X_n)/(\tfrac{1}{2}\rho V^2).$$

This results in a normalized second derivative equation:

$$Y_n''(X_n)=\Delta P_n(X_n)/T_A$$

where $\Delta P_n(X_n)/T_A$ varies from 0 to $-\beta$ in accordance with the Joukovsky difference pressure characteristic. Therefore the normalized characteristic equation can be written:

$$Y_n''(X_n)=\beta.$$

Thus, the normalized second derivative is defined by the normalized pressure difference along the chord (boom) axis. These normalization factors (as represented by $\beta$) become multipliers in determining the actual shape of the sail from its normalized profile. For example, higher wind forces increase the difference pressure and increase the second derivative (increasing $\beta$), as well as the actual lateral deflection, while higher sail tension decreases the second derivative (decreasing $\beta$) and the sail's lateral deflection.

Integrating the normalized second derivative twice with respect to the boom axis and meeting the boundary conditions at the ends, i.e. no lateral deflection at the ends, $Y_n(0)=Y_n(1)=0$, a sail profile, $Y_n$ with respect to $X_n$, can be derived from the Joukovsky pressure difference along the chord, the $X_n$, or boom axis. This sail profile, defined as the lateral deflection with respect to the boom axis, is then applied to the boom to force the lower part of a sail to develop the pressure difference characteristic of an efficient low speed airfoil, specifically a Joukovsky airfoil. The boom thus takes the lateral deflection shape that the sail should take in order to develop the desired efficient pressure difference.

First define $\alpha$ as the location along the normalized boom length corresponding to the maximum negative pressure difference location, as shown in FIG. 5. Then approximate the normalized (by $\beta$) Joukovsky pressure differential $Y_n''$ curve by fitting one curve between $Y_n=0$ and $Y_n=\alpha$ and a second curve between $Y_n=\alpha$ and $Y_n=1$, observing the boundary conditions that $Y_n(0)=Y_n(1)=0$ and that $Y_{n1}(\alpha)=Y_{n2}(\alpha)$ and $Y_{n1}'(\alpha)$-

$=Y_{n2}'(\alpha)$. The generalized solution for the two curves is given by:

$$Y_{n1}''=-\beta X_n/\alpha \text{ for } 0\leqq X_n\leqq\alpha$$

and $$Y_{n2}''=-\beta+\beta(X_n-\alpha)^{0.5}/(1-\alpha)^{0.5} \text{ for } \alpha\leqq X_n\leqq 1.0.$$

For example, assuming $\alpha=0.05$, integrating and matching the boundary conditions yields:

$$Y_{n1}=-3.33\ \beta\ X_n^3+0.2347\ \beta\ X_n \text{ for } 0<X_n\leqq 0.05$$

and $$Y_{n2}=-\beta X_n^2/2+0.274\ \beta\ (X_n-0.05)^{2.5}+0.2597\ \beta\ X_n-0.0004\ \beta \text{ for } 0.05\leqq X_n\leqq 1.0.$$

Note that $X_n=0.05$ is a close estimate of the maximum negative difference pressure location $\alpha$ (x/L location) for the Joukovsky airfoil profile as shown in FIG. 5. This method is not, however, limited to an exact 0.05 location. The same method can be applied if the estimates of the negative maximum $\alpha$ vary from 0.04 to 0.06. Under such circumstances the mathematical coefficients would be somewhat different but the sail profile would be very similar. The point is that the pressure difference characteristic must closely match that of the Joukovsky airfoil in order to realize the increased thrust and improved handling.

Integrating and matching boundary conditions yields:

$$Y_{n1}=-\beta X_n^3/6\alpha+A_1\ X_n \text{ for } 0\leqq X_n\leqq\alpha$$

and $$Y_{n2}=-\beta X_n^2/2\alpha+\beta(X_n-\alpha)^{2.5}/(3.75\ (1-\alpha)^{0.5})+A_2\ X_n+B_2 \text{ for } \alpha\leqq X_n\leqq 1.0.$$

where:

$$A_1=-\beta\alpha/2+A_2,$$

$$A_2=+\beta\alpha^2/6+\beta/2-\beta(1-\alpha)^2/3.75,$$

and $$B_2=+\beta/2+A_2.$$

Figure 10:
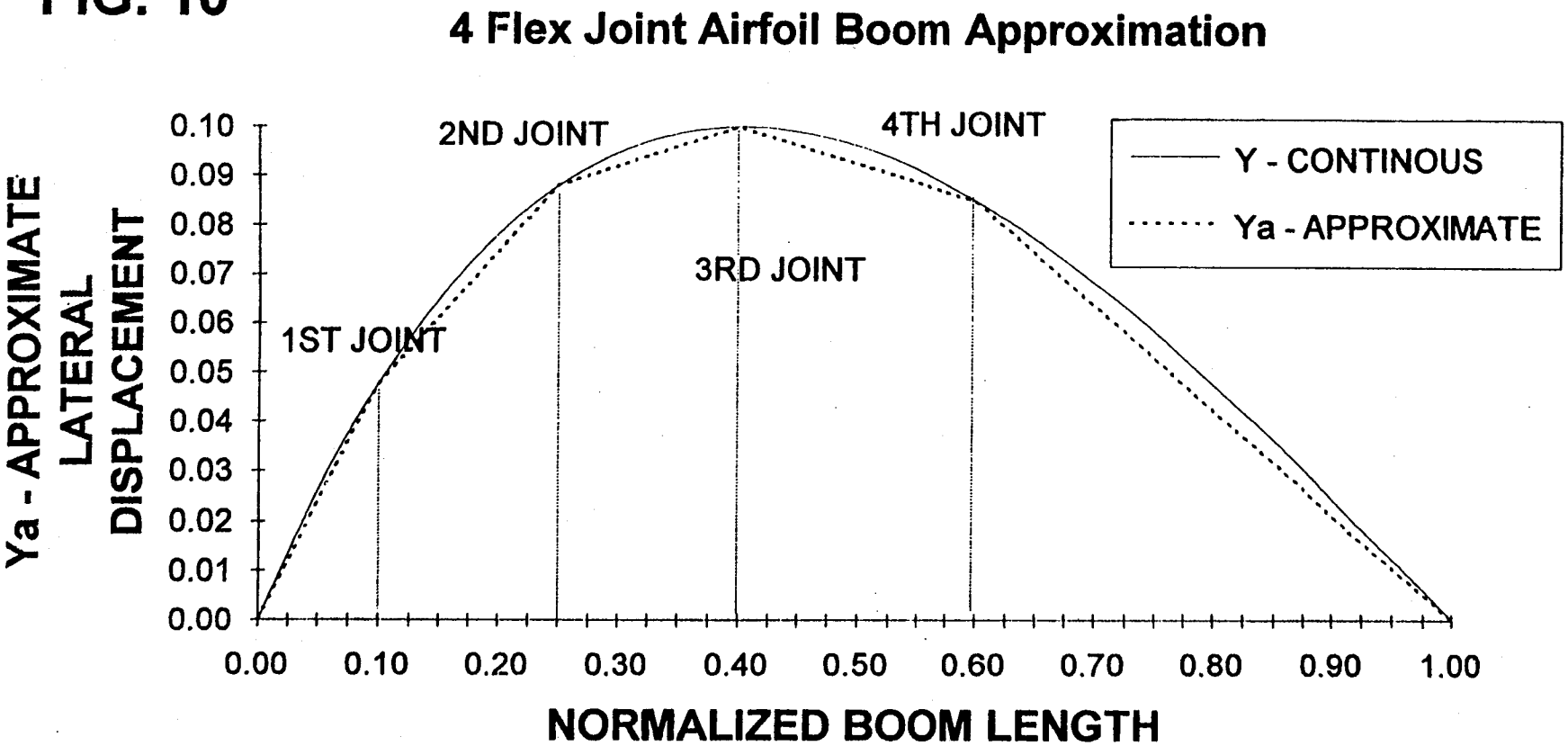
FIG. 10 is a plot of a five-segment four hinge approximation of the Joukovsky generated airfoil profile lateral displacement as a function of normalized length.

Assuming normalization factors such that the maximum lateral deflection of a sail will be ten percent of the boom length, and performing piecewise approximations of the Joukovsky-derived curved lateral displacement as derived above, a configuration using five straight segments produces the values shown below and plotted in FIG. 10, where $X_n$ is the normalized distance along the boom from the mast, $Y_a$ is the approximated boom lateral deflection, and the angle is measured between the corresponding boom segment and the undeflected boom.

| Joint No. | $X_n$ | $Y_a$ | Angle |
|---|---|---|---|
| | 0.00 | 0.000 | |
| 1 | 0.10 | 0.048 | 25.64 |
| 2 | 0.25 | 0.088 | 14.93 |
| 3 | 0.40 | 0.100 | 4.57 |
| 4 | 0.60 | 0.085 | −4.29 |
| | 1.00 | 0.000 | −12.00 |

Figure 11:
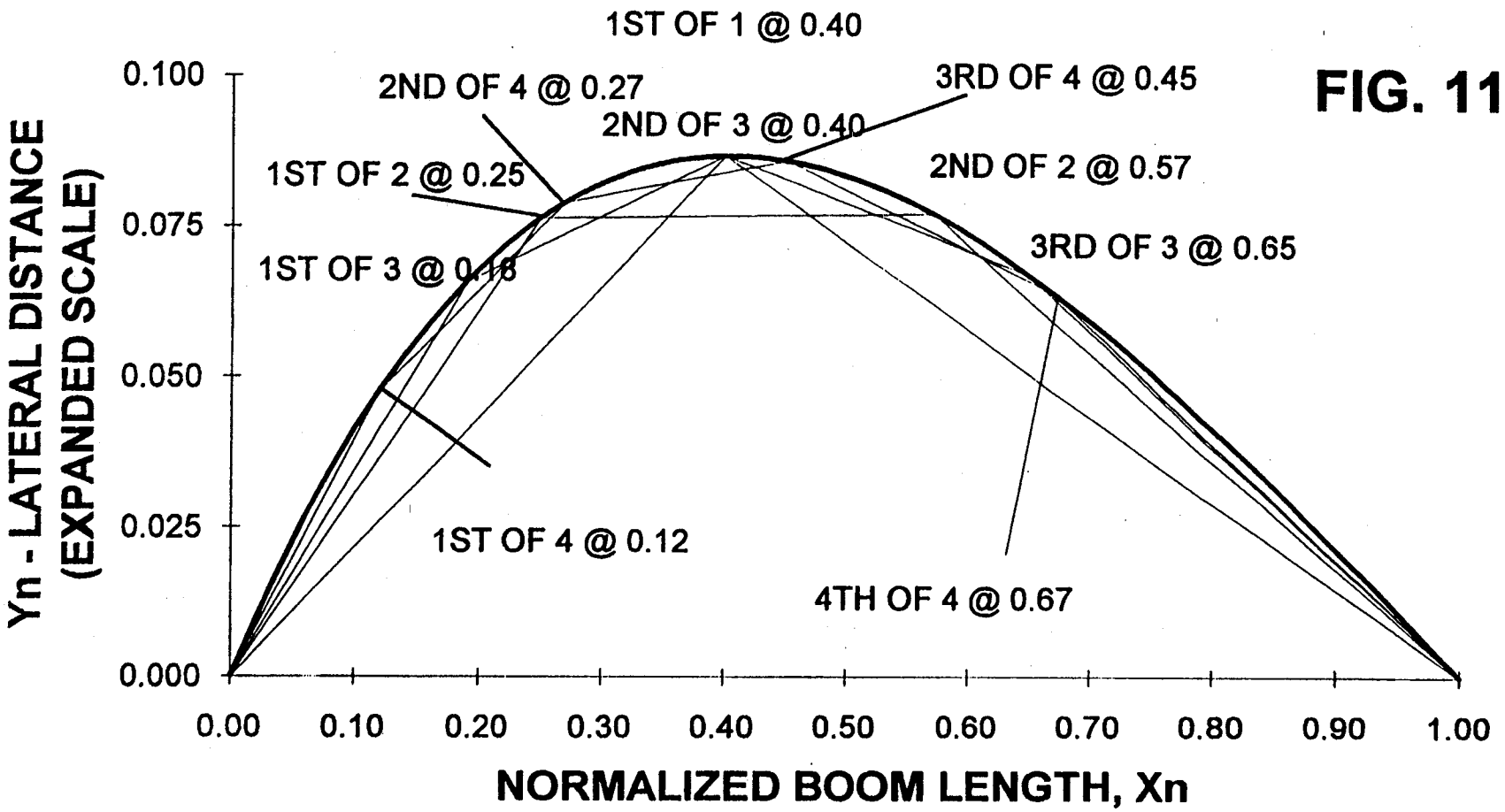
FIG. 11 is plot of total lateral displacement error between a Joukovsky generated airfoil profile and one, two, three and four hinge approximations as a function of hinge location along a normalized length.

The piecewise approximation is determined using a computerized numerical iteration program. The boom is divided into 101 stations, from 0.00 to 1.00, (0.00, 0.01, 0.02 etc). Boom stations are selected for the flex joints and straight links connecting these joints, and the 0.00 and the 1.00 boom stations are mathematically drawn. Then the horizontal or lateral differences between link deflection and that of the Joukovsky-derived airfoil are summed station by station to determine the total error. This procedure is repeated all along the boom until the error sum is minimized. For one to four flex joints the iteration results are shown in FIG. 11. For the single boom joint approximation the joint station for minimum error is at 0.40 of boom length. This is consistent with the foregoing analysis since the Joukovsky-derived profile maximum deflection is at this station.

The approximation using five boom segments connected by four flex joints is a practical trade-off between precision and complication, however the present invention is not limited by this example.

Note that the flex joints do not bend very far. The initial twenty-five degree angle is not due to flex joint rotation but to the pivot of the front of the boom on the mast. The airfoil boom must be able to flex in either direction. The angular flexure between each section is limited by hard stops that do not allow additional motion. These Joints also incorporate shock absorber pads (snubbers) to reduce the severe jolt that sometimes occurs when jibing due relative wind shifts. The piecewise approximation to the continuous airfoil deflection was achieved by examining three, four and five flex joints and calculating the difference between continuous and approximate contours. With four flex joints the error is never more than ten percent of the deflection midway between the Joints. The optimum flexure positions along the chord were determined by sliding the joints back and forth along the boom (i.e., computing the error for joints located at different boom length locations) to minimize the error. The advantage of five joints over four is small whereas four joints are significantly better than three. If another airfoil profile were used a different number of flexure joints might be appropriate. Again, however, the invention is not limited by the number of flexure points to approach an optimum airfoil profile.

The additional length of the boom is 2.8 percent for a ten percent maximum lateral deflection. If the lateral deflection is twenty percent, the length extends 9.7 percent. In actuality the maximum deflection for a Joukovsky-derived airfoil profile is usually ten percent or less to avoid flow separation and subsequent loss of lift along the top surface. Thus the additional length is very small and can be handled within the tolerance of normal rigging.

For traditional straight boom sailing, the maximum deflection of the sail occurs above the boom and generally ranges from about ten percent of chord length for upwind sailing in heavy winds to about seventeen percent for upwind sailing in light winds. Because of the increased propulsive efficiency and lowered center of wind force obtainable with a Joukovsky contoured beam, about a ten percent draft or deflection appears appropriate.

In use, winch 57 of FIG. 2 is operated to tension cable line 53 on the windward side of the boom, simultaneously relaxing the cable 54 on the leeward side. The boom is swingably hinged to the mast and is comprised of five articulated sections. Flex joints constrained to rotate only in the lateral plane are disposed between adjacent pairs of the five sections.

As tension is applied to the cable the articulated boom arches laterally at the flex joints, each joint rotating to a predetermined hinge angle. Both the section lengths and the hinge angles are selected and calculated to correspond to a piecewise approximation of a shape that will impose the pressure distribution of a particular defined aerodynamic profile, for instance the Joukovsky airfoil, on the foot of the sail.

Hard rubber bellows disposed between abutting section ends are sized to limit flex joint angular rotation to the selected values. When sufficient tension has been drawn on the cable to seat each flex joint at its intended angle and thus to fully shape the boom into the desired airfoil contour, the winch ratchet is set to maintain cable tension and boom airfoil profile.

Coming about, or reversing the leeward and windward sides of the sail, is accomplished by releasing the winch ratchet, relaxing the previously tensioned cable and tensioning the previously relaxed cable to reverse the direction of arching in the boom, and once again setting the ratchet to maintain the desired tension. An un-arched straight boom configuration can be selectively attained by tensioning the two opposed cables equally.

In an alternative embodiment the desired Joukovsky-derived airfoil profile is achieved by varying the cross-sectional moment of the boom beam to control and match the local bending curvature along the boom to the Joukovsky-derived profile.

As defined earlier, the airfoil profile is achieved by integrating the pressure difference twice since the pressure difference is proportional to $Y_n''$, the second derivative of the profile along the beam chord. However, it is noted that the negative reciprocal of $Y_n''$ is equal to the radius of curvature of the beam. The beam radius of curvature r is defined by $$r=EI/M,$$

where E is the modulus of elasticity, I is the beam cross-sectional moment of inertia and M is the applied torque. Thus the second derivative of the profile along the beam chord (defined by the pressure difference) defines the beam radius of curvature. This radius of curvature can be controlled by changing the beam cross-sectional moment of inertia along the chord to produce a beam, in this case a boom, having a continuous radius of curvature following a Joukovsky-derived profile. There are several means to vary the inertia along the beam, for example by thinning a solid beam, by hollowing out a solid beam, by a combination of the two, etc.

Referring back to FIG. 5, note that the $Y_n''$ starts at 0, falls to $-\beta$ and then returns to 0 along the boom chord. The radius of curvature is the negative reciprocal of $Y_n''$, and thus is undefined at stations zero and one along the boom. For practical reasons a large radius was selected as an approximation. At the boom station where $Y_n''/\beta$ is $-1$, the radius of curvature is the smallest. The ratio of these two radii defines the change in the width of the beam (for the solid beam) and the hollowed out width (for the hollowed boom beam).

Figure 12:
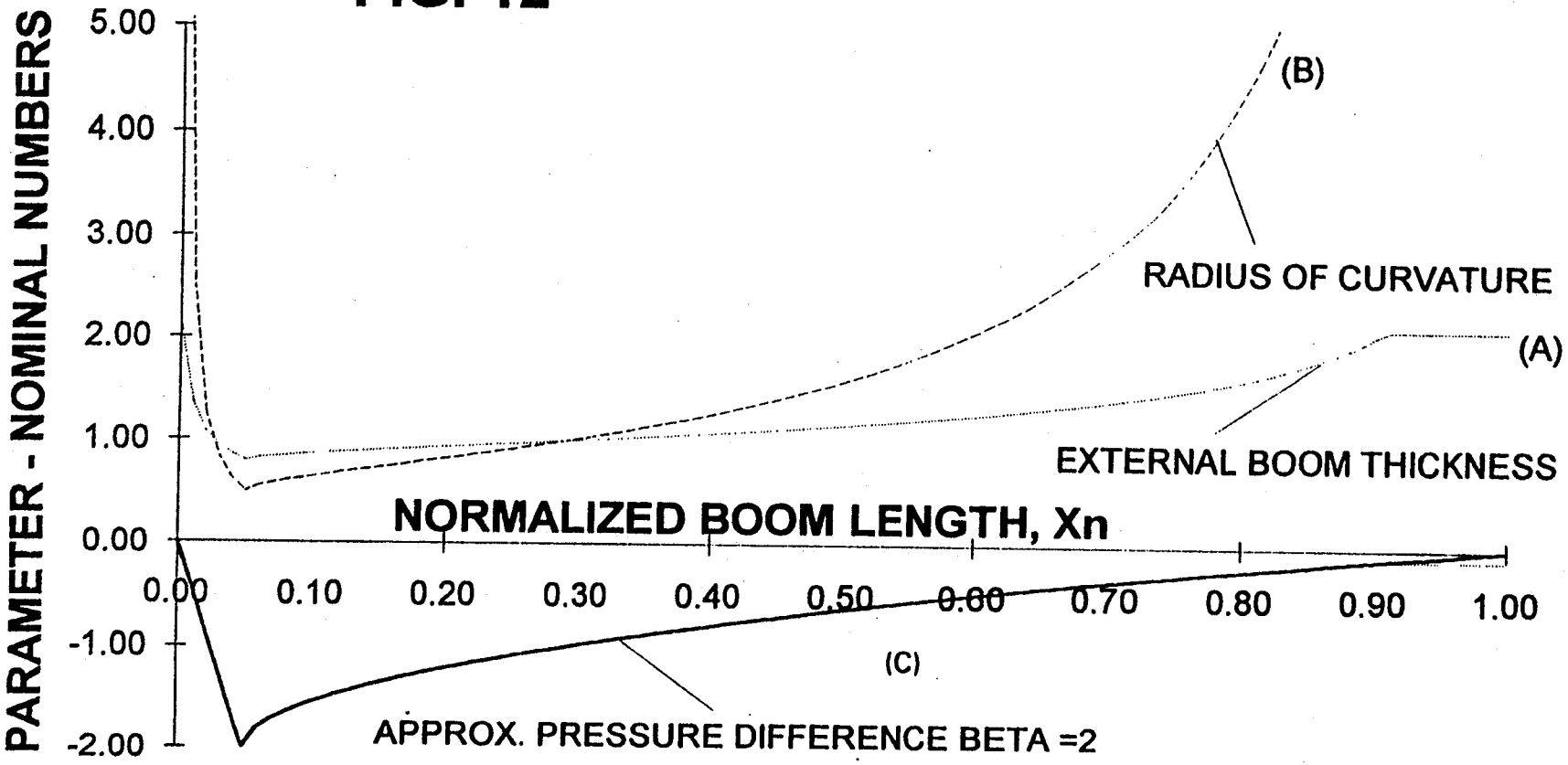
FIG. 12 is a plot of boom thickness, radius of curvature and pressure difference along a flexible boom sized to flex according to a Joukovsky generated airfoil profile as a function of normalized boom length.

In the flexible joint configuration of FIG. 2 the profile was approximated by using five sections (each with an infinite radius of curvature) and four flex joints. In the flexible beam, the radius of curvature is approximated at each end of the boom to mechanize an airfoil flexible boom. In FIG. 12, (a) the external width or lateral thickness of a flexible boom configured to deflect into a Joukovsky-derived profile, (b) the radius of curvature and (c) the approximate pressure difference are shown as a function of normalized boom length. The approximation limits the radius to a nominal undimensioned value of ten, resulting in a thickness change from 2.15 to 0.79, or thirty-seven percent of the full width at either end.

The ratio of the largest radius of curvature to the smallest has a significant impact on the thickness dimensions of the boom at the most flexible section, for example:

| Radius (boom station 0 & 1.0) | =20 | =10 | =5 | =2.5 |
|---|---|---|---|---|
| External width (at boom station $X_n = \alpha = 0.05$) | 0.292 | 0.369 | 0.464 | 0.585 |
| Internal width (at boom station $X_n = \alpha = 0.05$) | 0.992 | 0.983 | 0.961 | 0.928 |

Note, the radius at the boom station 0.05 is 0.5. This is the boom station with the smallest radius of curvature. This boom station is where the pressure difference is the greatest.

The approximation for the unitary flexible boom is in the radius of curvature at each end of the boom whereas in the flex joint configuration the approximation is in the profile. As a large radius of curvature is assumed, the material thickness thins down considerably at $X_n=\alpha$. This poses a problem because the stress at the thinnest section is high. Therefore, a radius of curvature at the boom ends of ten or five times the minimum radius of curvature is considered an adequate approximation.

Figures 13, 18:
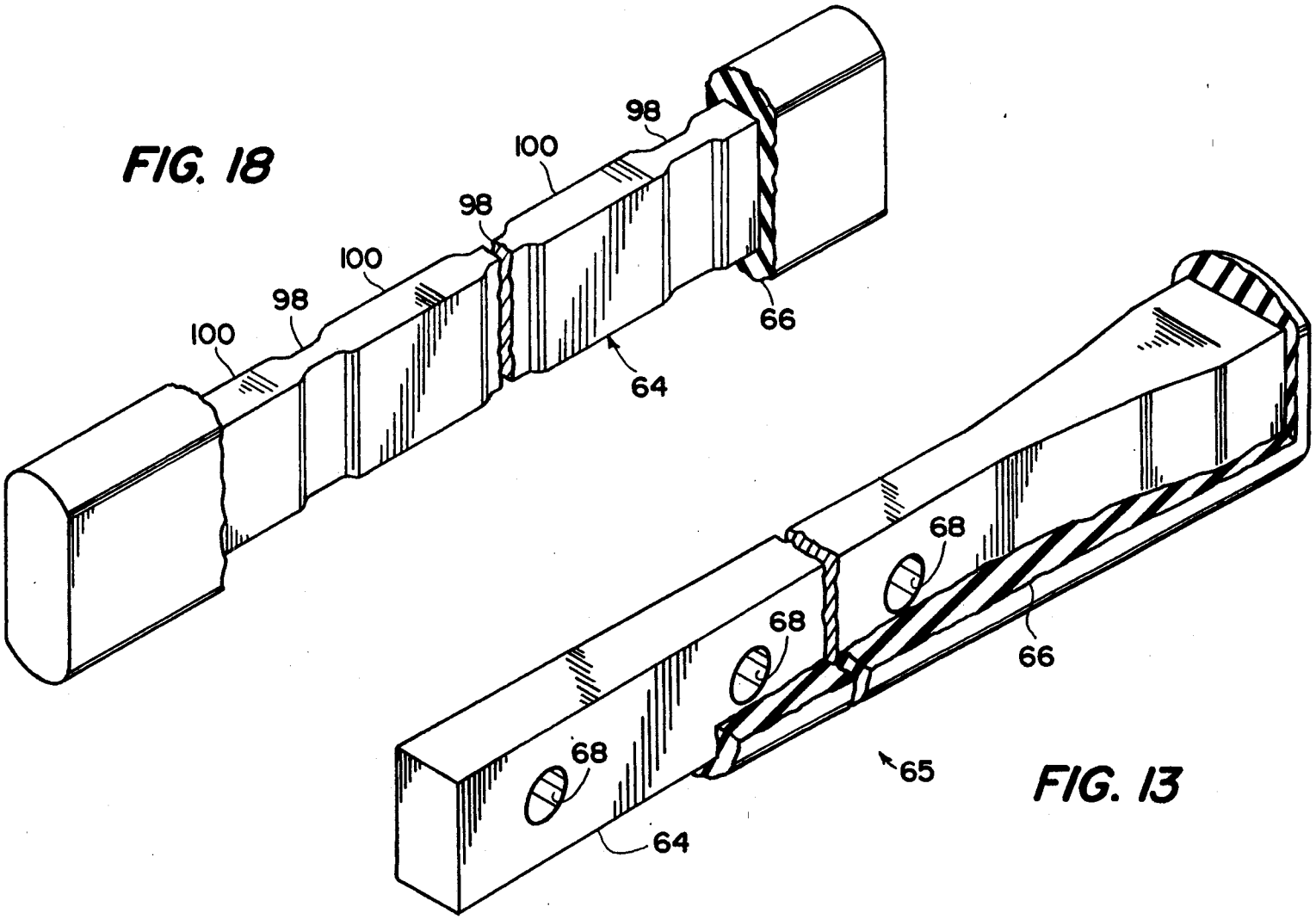
FIG. 13 is a broken perspective view of a sailboat boom according to the present invention having a Joukovsky profiled beam encased in hard rubber.
FIG. 18 is a partially cut-away perspective view of a sailboat boom according to the present invention having a beam with contoured sections machined to act as flex joints to approximate a Joukovsky generated airfoil profile.

One example of this embodiment, particularly well suited to recreational sailing applications, is shown in FIG. 13. A thin beam 64 is used as the strength member for a flexible Joukovsky boom 65. The thin width of this beam is contoured as the Joukovsky-derived profile radius of curvature demands in accordance with the selectively varied cross-sectional moment of inertia discussed previously. The thin beam is large in the vertical dimension and thus very stiff in opposition to vertical deflection. This thin beam is encased in hard rubber 66 and has through holes 68 to allow the molding rubber to flow through the beam for better bonding and encapsulation. The beam has the external appearance of a conventional sail boom and has no hard or abrasive surfaces. This is an inexpensive means of mechanizing the airfoil sail boom and can readily be used with the flexure control approaches discussed previously.

Figure 14:
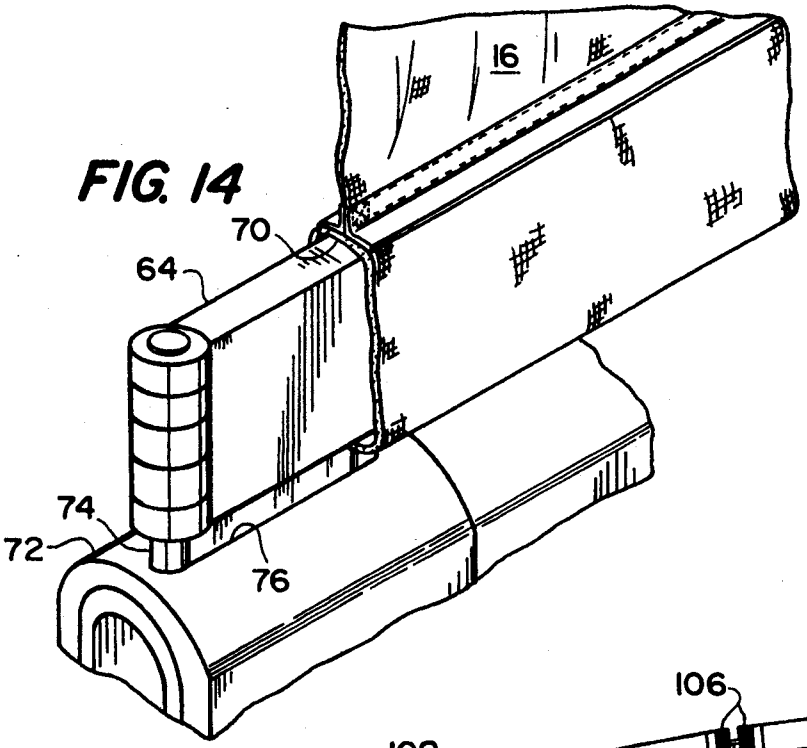
FIG. 14 is a partially cutaway perspective view of a sail having a Joukovsky generated airfoil shaping insert in a pocket in the foot of a sail.
Figures 15, 16, 17:
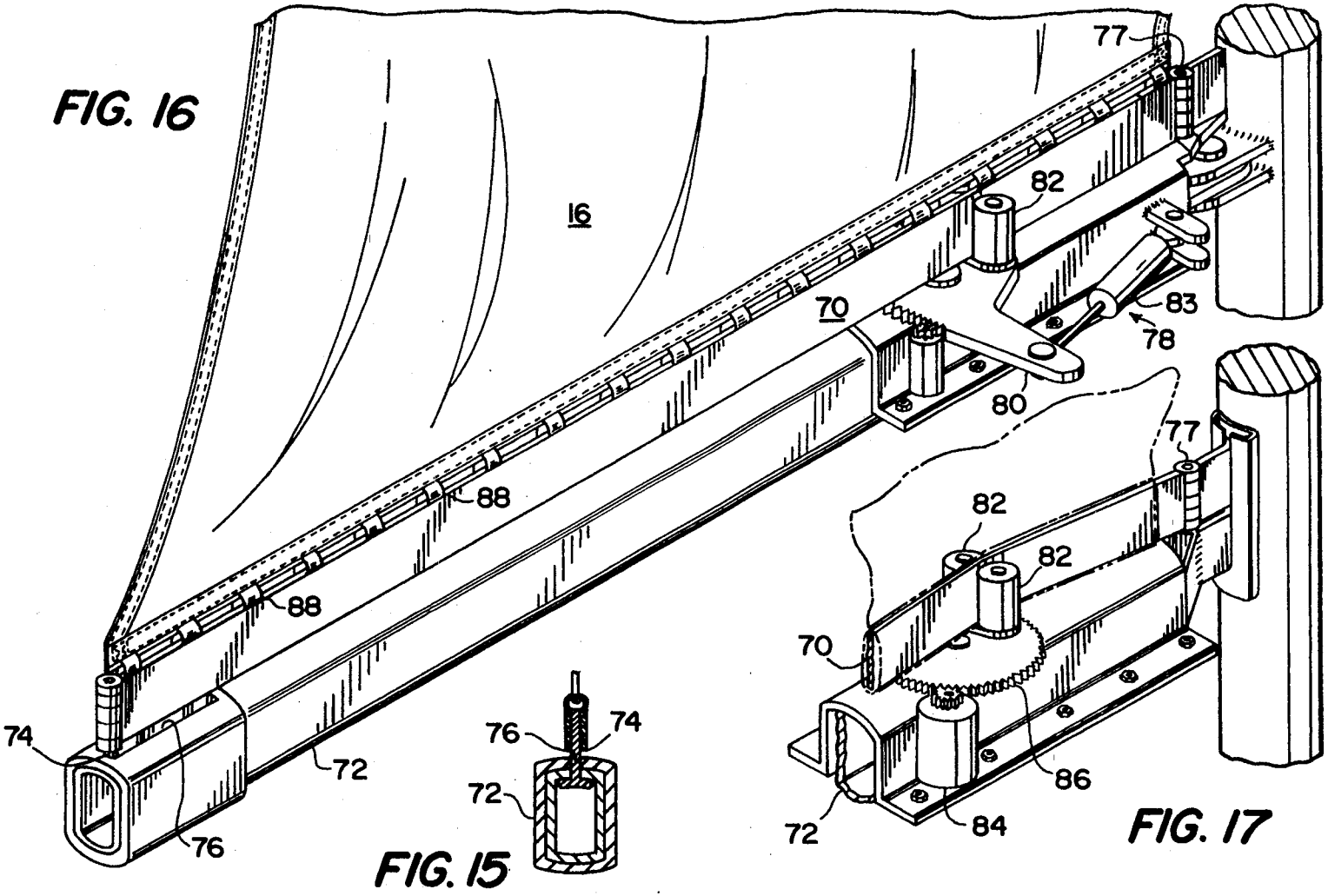
FIG. 15 is a cross-section of the inverted "T" fastener of FIG. 14.
FIG. 16 is a partially cutaway perspective view of an alternative tensioning mechanism using rollers attached to a rotatable lever arm to deflect the airfoil boom.
FIG. 17 is a perspective view of a boom deflector having a DC electric motor geared to rotate a support plate to flex the metal strip insert.

A variation on this contoured beam, shown in FIG. 14, consists of a sewn pocket 70 along the bottom of the sail 16. A thin beam or plate 64, contoured to take the Joukovsky-derived profile when tensioned, is inserted into this pocket. The insert provides sufficient vertical stiffness to permit the sail to be fastened only at the fore and aft ends. This arrangement allows the sail to take the airfoil profile even when attached to a conventional straight boom 72. The aft connection 74 is an inverted "T" fastener hinged to the aft end of the beam and slidably mounted in a slot 76 attached to the boom as shown in FIG. 15. This allows the aft end of the sail to move forward as the sail deflects. The forward connection 77 shown in FIG. 16 is either a rotatable hinge attached to the mast or a fixed attachment to the forward portion of the boom. The inserted contoured beam provides the profile control, sufficient sail vertical stiffness and fastening to the sail cloth to allow the use of only the two attachments. In this variation the conventional boom can be used and only the sail need be modified. Flexing of the beam into a Joukovsky-derived profile is accomplished as previously described using either manual or power-assisted tensioning of cables 53 and 54 as shown in FIG. 3.

An alternative tensioning mechanism 78, shown in FIG. 16, has a lever arm 80 attached to the conventional boom and supporting a pair of rollers 82 which constrain the contoured insert 64. As the arm is rotated clockwise or counterclockwise the thin plate beam is deflected and undergoes the action of an applied torque resulting in the plate beam taking the airfoil profile. The arm can be actuated by winchable cables, by the action of a pneumatic/hydraulic push-pull piston 83, or by a d.c. electric motor 84 geared to rotate a circular plate 86 supporting the rollers, as shown in FIG. 17, similar to the way a starter motor is geared to rotate an engine flywheel. Also shown in FIG. 16 is a track of sail attachment reliefs 88 on the upper edge of the boom bar 64 to allow the sail to be attached in the same manner that sails are attached to conventional booms, i.e., by track and slides rather than by insertion into a sewn pocket as shown in FIG. 14. The boom bar track is segmented to allow for boom bar flexure.

A thin contoured beam 64 inserted into a pocket 70 sewn laterally across the sail foot is shown in FIG. 14. This concept can be extended to include sail shaping stays 89 contoured to flex following a preselected efficient airfoil contour inserted into lateral pockets 91 at intervals along the height of the sail, as illustrated in FIG. 1.

Figure 19:
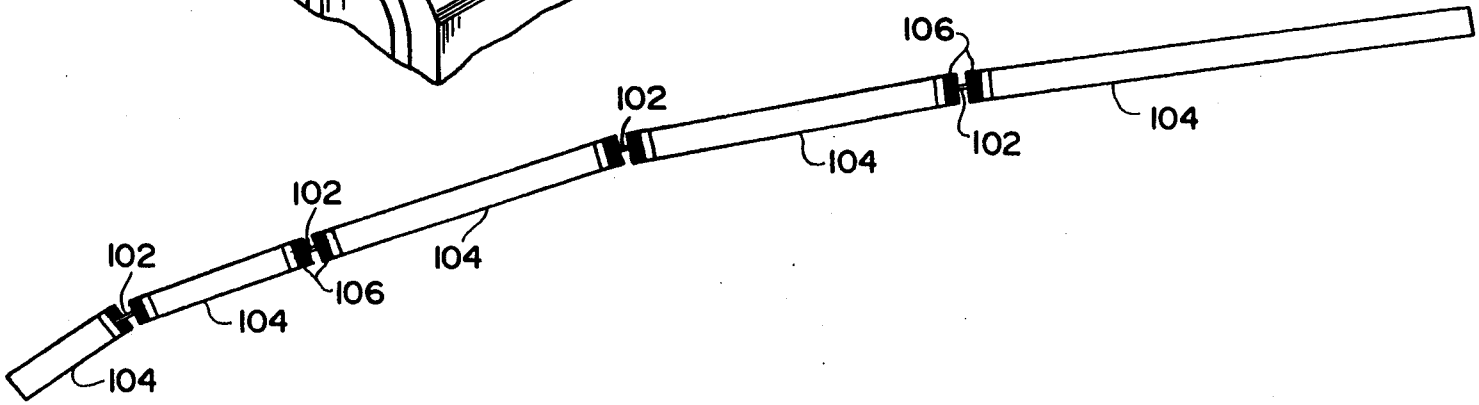
FIG. 19 is a diagrammatic top plan view of a conventional sailboat boom sectioned into segments and connected by spring joints disposed to flex into a Joukovsky airfoil contour.

FIG. 18 and 19 show hybrid combinations of the articulated boom of FIG. 2 and the controlled radius of curvature boom of FIG. 13. Referring to FIG. 18, a thin beam 64 of constant cross-sectional moment of inertia has narrowed sections 98 located at appropriate joint locations, each narrowed section having a cross-sectional moment corresponding in length and thickness to the radius of curvature required to produce the angles between segments 100 determined by the piecewise approximation method described above. These narrowed segments 98 act as the flex joints and the un-narrowed sections 100 between them act as the segments to reproduce a Joukovsky-generated airfoil contour in the boom. A hard rubber casing 66 can enclose the beam.

In FIG. 19 individual "H"-shaped spring joints 102, machined to appropriate thickness to match spring rates required to produce the flexure associated with a selected airfoil contour, are affixed to join cut segments 104 of a conventional sailboat boom. Hard rubber snubbers 106 attached to the inner surface of the spring joints 102 limit flexure and absorb shock loads.

Imposing a proven airfoil configuration on the foot of a sail improves the aerodynamic efficiency of the entire height of the sail. More particularly, forcing the lower portion of the sail to follow an airfoil profile has multiple positive impacts over the prior art straight boom constraint. The increased air flow, including surface reflected wind, and the larger surface area of the sail near the foot results in substantially increased net thrust, or forward drive, when efficiently shaped. The center of force of this increased thrust is substantially lowered to provide improved stability and handling. By reducing the center of pressure on the sail relative to the center of buoyancy of the hull, the heeling moment is lowered from about 40% of the mast height to only about 24% of the mast height. This very significant displacement allows the boat to maintain a dramatically more hydrodynamically efficient, upright position at higher speeds.

The boom apparatus of the present invention can be easily and unencumberingly substituted for straight booms on existing or new construction sailboats and the contoured beam and sail foot pocket application can be inexpensively added to enhance sail performance on straight boom sailboats. A variety of simple control mechanisms can be used to selectively flex the sail into the predetermined airfoil shape and an automated feedback control system can be included to optimize flexure for changing sailing conditions.

Inasmuch as the present invention is subject to many variations, modification and changes in detail, it is intended that the subject matter discussed above and shown in the accompanying drawings be interpreted as illustrative and not in a limiting sense.

What is claimed is:

1. A boom apparatus for a sailboat comprising:

a beam swingably extending horizontally from the sailboat mast for attachment to the foot of a sail; and means for selectively controlling the flexure of said beam in either direction in a horizontal plane to impose a shape onto said beam producing a pressure distribution corresponding to the pressure distribution of a predetermined airfoil profile.

2. The boom apparatus of claim 1 wherein said predetermined airfoil profile is the Joukovsky airfoil.

3. The boom apparatus of claim 1 wherein said predetermined airfoil profile is the NACA 0018 airfoil.

4. The boom apparatus of claim 1 wherein said beam comprises a plurality of rigid segments attached end to end by flex joints controllably rotatable in the horizontal plane, said flex joints are constrained to assume preselected angles when said beam is flexed, and said number and length of said plurality of rigid segments and said angles assumed by said flex joints are determined by a piecewise linear approximation of said predetermined airfoil profile.

5. The boom apparatus of claim 4 wherein said predetermined airfoil profile is the Joukovsky airfoil.

6. The boom apparatus of claim 4 wherein said predetermined airfoil profile is the NACA 0018 airfoil.

7. A boom apparatus for a sailboat comprising:

a beam swingably extending horizontally from the sailboat mast for attachment to the foot of a sail;

a plurality of rigid segments attached end to end by flex joints controllably rotatable in the horizontal plane;

means for selectively controlling the flexure of said beam in either direction in a horizontal plane into a shape producing a pressure distribution corresponding to the pressure distribution of a predetermined airfoil profile;

said means includes tensioning cables extending along the two lateral sides of said sailboat boom and mechanical stops limiting the angular rotation of each of said flex joints; and said mechanical stops are hard rubber bellows disposed on the lateral sides of said flex joints between said rigid segments.

8. The boom apparatus of claim 7 further comprising means to selectively pressurize said hard rubber bellows to control said flex angles.

9. The boom apparatus of claim 8 wherein said pressurization means includes pneumatic pressure lines in controllable communication with a high pressure gas source and controllable relief lines in communication with atmosphere.

10. A boom apparatus for a sailboat comprising:

a beam swingably extending horizontally from the sailboat mast for attachment to the foot of a sail; said beam including a horizontally elongate plate having large height to lateral width ratio to provide vertical rigidity and having lateral thickness narrowed at a plurality of preselected locations along said beam, said narrowed beam sections producing joints of flexure in the lateral direction in said beam and defining a number of beam segments therebetween, each of said narrowed sections being narrowed to produce preselected angles of flexure on said beam and being located to define beam segments of preselected length; and means for selectively controlling the flexure of said beam in either direction in a horizontal plane into a shape producing a pressure distribution corresponding to the pressure distribution of a predetermined airfoil profile.

11. The apparatus of claim 10 wherein said number and angles of flexure of said plurality of flex joints and said lengths of said beam segments are selected to produce a flexed shape in said beam to produce a pressure distribution corresponding to the pressure distribution of said predetermined airfoil profile.

12. A boom apparatus for a sailboat comprising:

a beam swingably extending horizontally from the sailboat mast for attachment to the foot of a sail;

wherein the cross-sectional moment of inertia of said beam varies along the length of said beam to produce a continuous lateral radius of curvature in accordance with the continuous radius of curvature of said predetermined airfoil-derived shape; and means for selectably controlling the flexure of said beam in either direction in a horizontal plane into a shape producing a pressure distribution corresponding to the pressure distribution of a predetermined airfoil profile.

13. The boom apparatus of claim 12 wherein said predetermined airfoil profile is the Joukovsky airfoil.

14. The boom apparatus of claim 12 wherein said predetermined airfoil profile is the NACA 0018 airfoil.

15. The boom apparatus of claim 12 wherein said beam is a solid beam and said cross-sectional moment of inertia is provided by a varying thickness of said solid beam along the beam length in a predetermined manner.

16. The boom apparatus of claim 12 wherein said cross-sectional moment of inertia is provided by variably hollowing said beam along its length in a predetermined manner.

17. The boom apparatus of claim 12 wherein said beam is a horizontally elongate plate having a high height to lateral width ratio to provide vertical rigidity and having a lateral thickness varying in a predetermined manner to produce a continuous lateral radius of curvature in accordance with the continuous radius of curvature of said predetermined airfoil-derived shape.

18. The boom apparatus of claim 17 wherein said predetermined airfoil profile is the Joukovsky airfoil.

19. The boom apparatus of claim 17 further comprising a hard rubber coating encasing said plate to impart a smooth curved surface to said boom.

20. The boom apparatus of claim 19 further comprising through-holes in said plate for passage of said hard rubber to improve bonding to said plate.

21. The boom apparatus of claim 12 wherein said means for controlling said flexure in said beam includes tensioning cables extending along the two lateral sides of said sailboat boom.

22. The boom apparatus of claim 21 further comprising a hand winch for selectively adjusting the tension in said cables and a selectably engagable ratchet for maintaining said tension.

23. A sail shaping apparatus comprising:

a horizontally elongate plate having a high height to lateral width ratio to provide vertical rigidity and having a lateral thickness selectively varied to produce a continuous lateral radius of curvature in accordance with the continuous radius of curvature of a shape producing a pressure distribution corresponding to the pressure distribution of a predetermined airfoil profile;

a pocket disposed along the foot of the sail of a sailboat sized to receive said plate;

an aft connector pivotably attached to the after end of said plate and slidably attached to the after end of the sailboat boom;

a forward connector pivotably attaching the forward end of said plate to the sailboat mast; and means for selectively controlling flexure in said plate in either direction in the horizontal plane into a shape closely approximating said predetermined airfoil-derived shape.

24. The sail shaping apparatus of claim 23 wherein said forward connector fixedly attaches said forward end of said plate to the forward end of said sailboat boom.

25. The said shaping apparatus of claim 23 wherein said plate flexure control means includes a lever arm rotatably mounted on a boom in the horizontal plane having vertical rollers disposed on either side of said plate and means for selectively rotating said lever arm clockwise and counterclockwise to deflect said plate.

26. The sail shaping apparatus of claim 23 further comprising:

at least one additional plate having a continuous radius of curvature in the lateral direction in accordance with the continuous radius of curvature of a shape producing a pressure distribution corresponding to the pressure distribution of a predetermined airfoil profile; and at least one pocket disposed along at least one chord of the sail above the foot of the sail disposed to receive at least one of said additional plates to produce said shape in the sail.

27. A boom apparatus for a sailboat comprising:

a beam swingably extending horizontally from the sailboat mast for attachment to the foot of a sail;

means for measuring the sail-induced strain in said mast; and automatic feedback control means responsive to said measured strain for flexing said beam to maximize said mast strain.

28. The boom apparatus of claim 27 wherein said automatic feedback control means selectively flexes said beam to approach without surpassing a preselected mast strain value.

29. A method for increasing the thrust and lowering the center of pressure of a sailboat sail comprising the steps of:

(a) replacing the generally rigid boom of a sailboat with a boom having selectably controllable flexure along the boom length in both directions in the horizontal plane;

(b) attaching the foot of a sail along said boom; and (c) selectably forcing said boom and said sail foot to assume a profile producing a pressure distribution corresponding to the pressure distribution of a predetermined airfoil profile.

30. The method according to claim 29 wherein said predetermined airfoil is the Joukovsky airfoil.

31. The method according to claim 29 further comprising the step of:

(d) forming the shape of the sail to conform to said airfoil derived profile.

32. A method for producing a sailboat boom selectively flexible to assume a shape producing a pressure distribution corresponding to the pressure distribution of a predetermined airfoil profile to increase sail efficiency comprising the steps of:

(a) performing piecewise linear approximations of a shape derived by twice integrating the pressure differential function associated with said specific airfoil profile to determine the number and lengths of rigid boom segments and the angles therebetween and thereby suitably approximate a boom profile having the pressure distribution corresponding to said profile;

(b) assembling a boom consisting of the number and lengths of segments as calculated in step (a) and connected by flex joints rotatable in the horizontal plane;

(c) constraining said flex joints to assume said calculated angles when the boom is flexed; and (d) selectively flexing said boom horizontally in a direction determined by wind conditions.

33. The method according to claim 32 wherein said boom segments comprise segments cut from a conventional straight boom.

34. A method for producing a sailboat boom selectively flexible to assume a shape derived from the pressure distribution of a predetermined airfoil profile to increase sail efficiency comprising the steps of:

(a) varying the cross-sectional moment of inertia of a sailboat boom along the boom length to produce a continuous lateral radius of curvature corresponding to the continuous radius of curvature of a shape producing a pressure distribution corresponding to said predetermined airfoil profile; and (b) selectively flexing said boom horizontally in a direction determined by wind conditions.

35. A method for adapting the foot of a sailboat sail to selectively assume a predetermined airfoil-derived profile comprising the steps of:

(a) forming a pocket extending horizontally along the length of the foot of a sail;

(b) inserting into said pocket a horizontally elongate plate having a large height to width ratio to provide vertical rigidity and having a lateral thickness varied along the horizonal plate length to produce a continuous lateral radius of curvature in accordance with the continuous radius of curvature of a shape producing a pressure distribution corresponding to the pressure distribution of said predetermined airfoil-derived profile; and (c) selectively controlling the flexure of said plate in each direction in the horizontal plane to assume said shape.

36. The method according to claim 35 wherein said predetermined airfoil-derived profile is the Joukovsky profile.

37. A method to improve the efficiency of a sailboat sail comprising the steps of:

(a) attaching the foot of a sail to a controllably flexible boom;

(b) measuring the strain induced in the mast of the sailboat;

(c) continuously adjusting the flex in said boom to cause the force exerted by said sail to approach a level corresponding to a preselected strain in said mast.

38. A boom apparatus for a sailboat comprising:

a beam swingably extending horizontally from the sailboat mast for attachment to the foot of a sail;

said beam having a plurality of rigid segments attached end to end by flex joints controllably rotatable in the horizontal plane;

said rigid segments being five in number and having normalized lengths of 0.10, 0.15, 0.15, 0.20 and 0.40 respectively in sequence from said mast and said flex joints being four in number and constrained to assume maximum angles with respect to an undeflected straight boom of 14.9°, 4.6°, −4.3° and −12.0° respectively in sequence from said mast so as to represent a piecewise approximation of a Joukovsky airfoil;

means for selectively flexing said beam in either direction to force said flex joints to assume said maximum angles.

* * * * *